US006192824B1

(12) United States Patent
Chang

(10) Patent No.: US 6,192,824 B1
(45) Date of Patent: Feb. 27, 2001

(54) ELECTROLIER FLAG

(76) Inventor: Chih-Chen Chang, No. 32, Kuang Hua South Street, Hsinchu City (TW)

( * ) Notice: Subject to any disclaimer, the term of this patent is extended or adjusted under 35 U.S.C. 154(b) by 0 days.

(21) Appl. No.: 09/223,801

(22) Filed: Dec. 31, 1998

(51) Int. Cl.[7] ..... G09F 17/00

(52) U.S. Cl. ..... 116/173; 116/202; 116/DIG. 5; 40/546

(58) Field of Search ..... 116/173, 174, 116/202, DIG. 5; 362/249, 252, 391; 40/546, 547, 564, 604; 428/7, 11

(56) References Cited

U.S. PATENT DOCUMENTS 2,688,303 * 9/1954 Leander ..... 116/173
3,890,497 * 6/1975 Rush ..... 362/473
4,110,818 * 8/1978 Hempsey ..... 362/493
4,627,278 * 12/1986 Soto ..... 73/170.06
4,733,488 * 3/1988 Yokoyama et al. ..... 40/544
4,833,443 * 5/1989 Siew ..... 340/473
5,477,437 * 12/1995 Lach ..... 362/252
5,519,595 * 5/1996 Wang ..... 362/234
5,576,078 * 11/1996 Schatz ..... 428/13
5,988,100 * 11/1999 Schmitt ..... 116/173

* cited by examiner

*Primary Examiner*—Andrew H. Hirshfeld
*Assistant Examiner*—R. Alexander Smith
(74) *Attorney, Agent, or Firm*—Rosenberg, Klein & Lee

(57) ABSTRACT

An electrolier flag is provided that is able to emit light by itself and revolves around a flag-rod under the effects of the wind. The integral flag unit is made form a transparent material and includes a banner portion and a lamp reflector portion. The lamp reflector of the flag is attached on a tube holding a string of bulbs by a pivotal connection, so that the light rays from the bulbs are conducted into the banner by the lamp reflector.

5 Claims, 6 Drawing Sheets

ELECTROLIER FLAG

BACKGROUND OF THE INVENTION

1. Field of the Invention

The present invention relates to an electrolier flag, and more particularly to an adornment flag that is able to emit light by itself and revolves around the flag-rod under effort of the wind.

2. Description of Prior Art conventional adornment flags, like a variety of advertising flags, vote propaganda flags, or house for sale marker flags are put on the top of the flag-rod provided for advertising flags, or tied on a long rope with a space maintained between them, meanwhile they decorate the outside of a house or building, Due to a lack of a luminous source, the advertising flags only can be used in the daytime, but at night, they will lose their commercial value,

OBJECTS AND SUMMARY OF THE INVENTION

In accordance with the shortcomings of the prior arts like being limited to daytime use and lack of an attractive appearance, and for bringing the advantages of the flag and the electrolier together so that the results and the commercial value of the advertising flag are improved, it is therefore a main object of the present invention to provide an electrolier flag that can emit light by itself for meeting the necessity of night use.

The second object of the present invention is to provide an eleatrolier flag such that the wind can revolve around the flag-rod for improving its appearance.

For achieving these objectives, the present invention provides an electrolier flag made from a transparent material and includes a banner portion and a lamp reflector portion. Wherein the lamp reflector is provided with two corresponding or complementary tube halves with, coupling components for locking the halves together when assembling the electrolier flag to a flag-rod, and a banner extended out from one or both sides of the opening of the lamp reflector. When the lamp reflector is attached on the tube that serves as a flag-rod, the light emitted from the bulbs on the inside of the tube can be condensed and led into the banner to make the banner emit the light. For reducing the friction area between the lap reflector and the outside wall of the tube, so that the light is not decreased by scratches, and to provide fluent and smooth rotary motion, the inside of the lamp reflector is provided with several ring-shaped fins at both ends and a middle position. Additionally, for increasing the reflecting efficiency of the lamp reflector, the inside of the lamp reflector is coated with an electroplated layer, except the connecting area between the banner and the lamp reflector in order to direct light rays to the banner portion.

Figure 3:
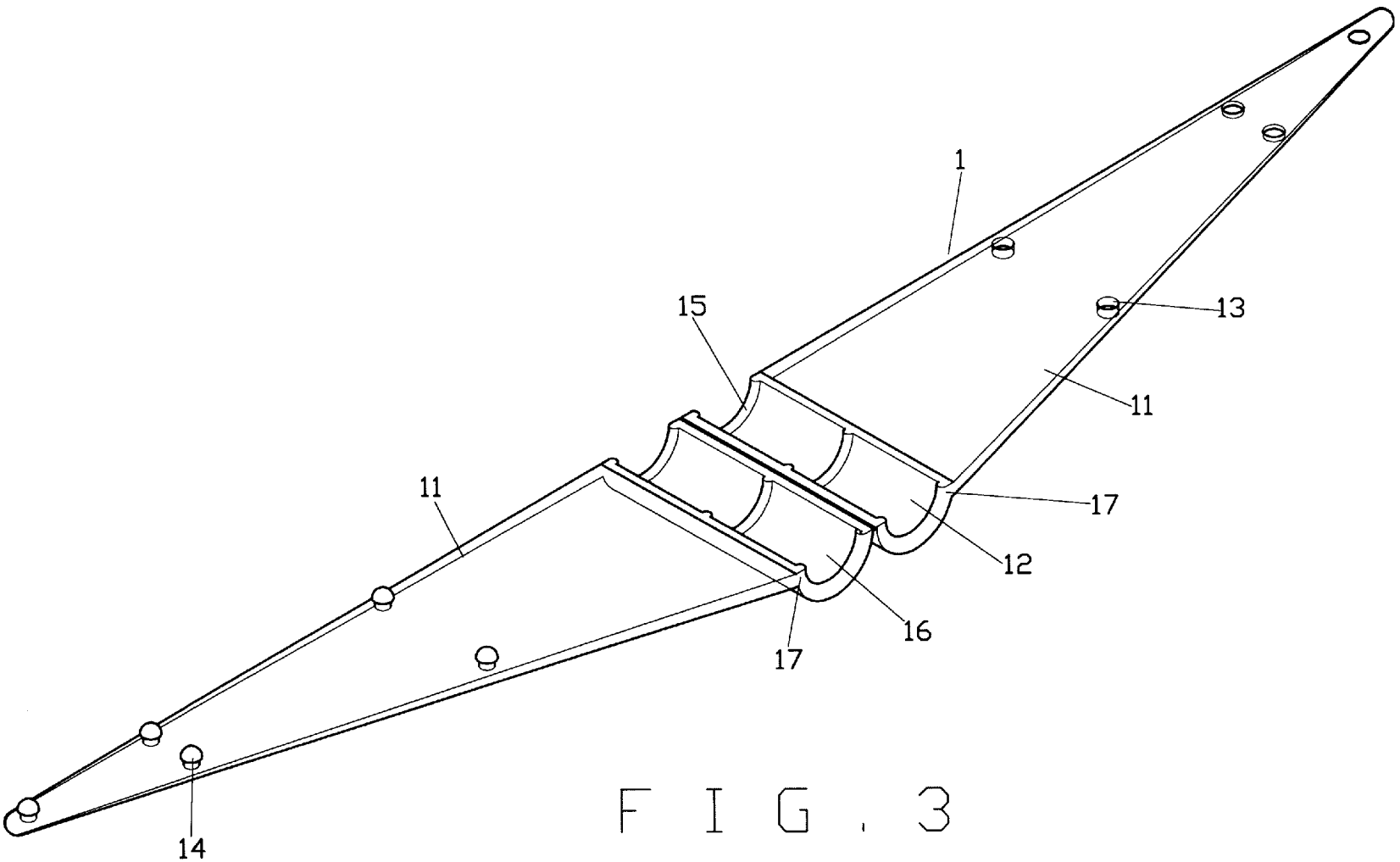
Figure 4:
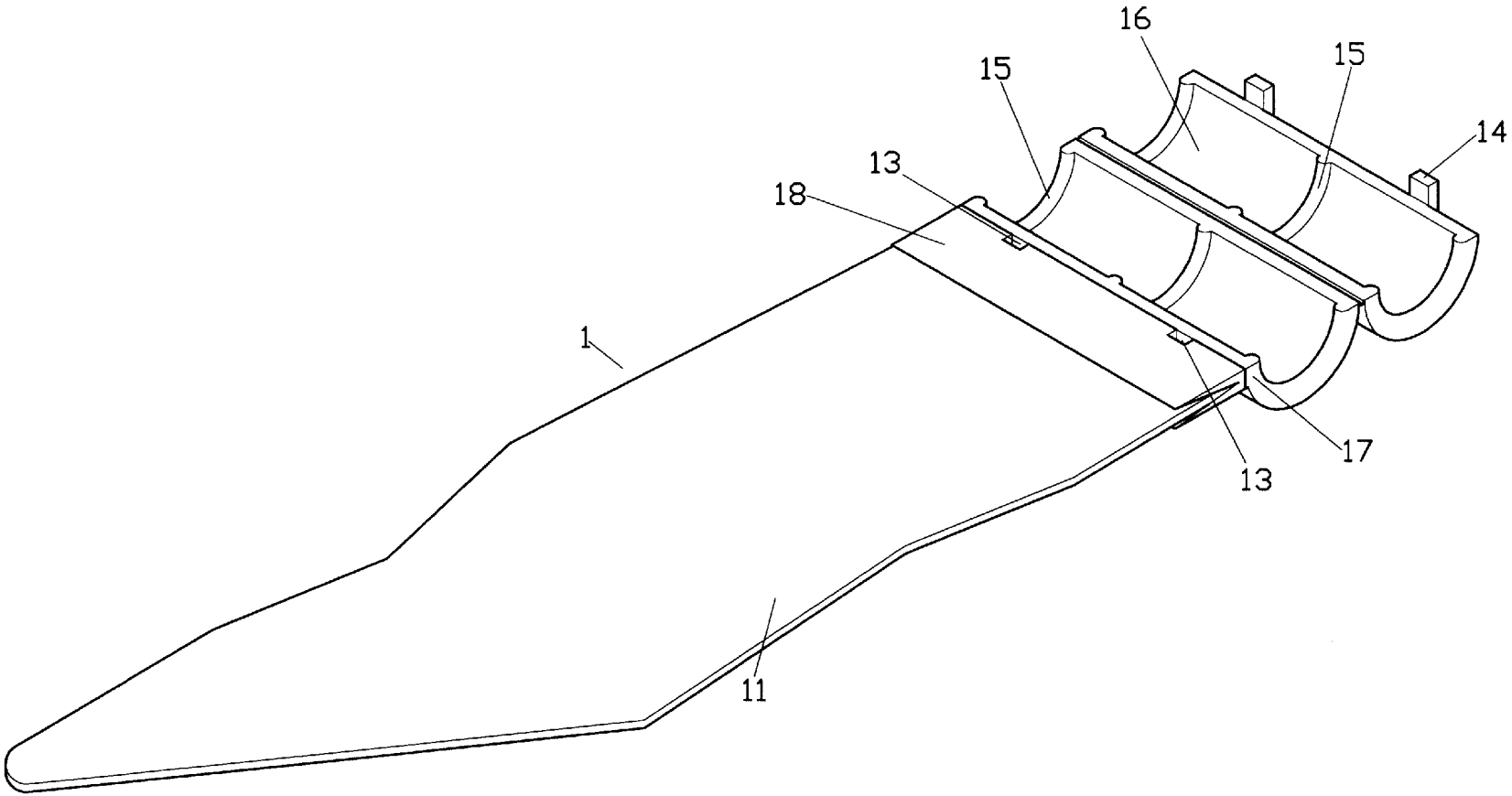
Figure 5:
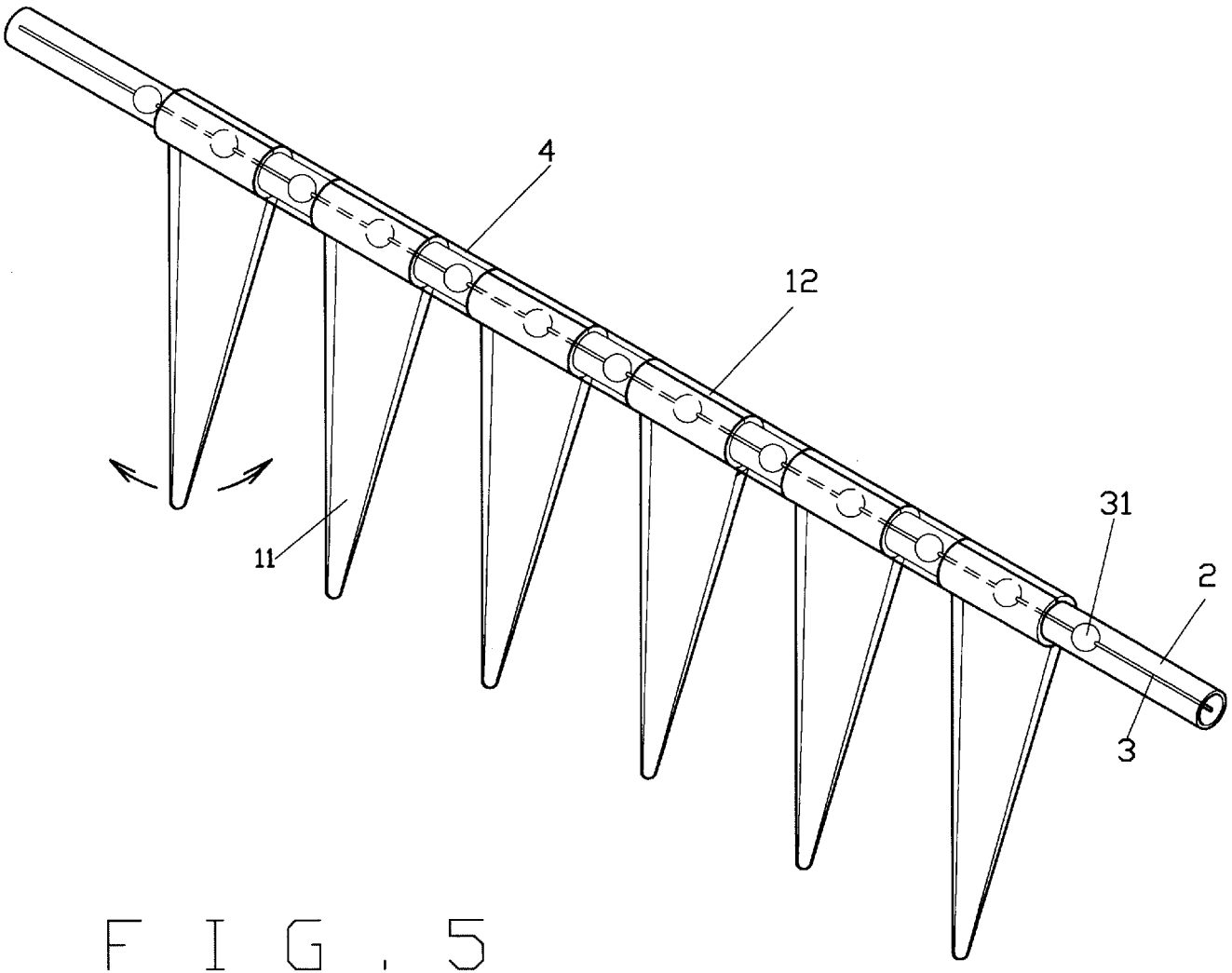
Figure 6:
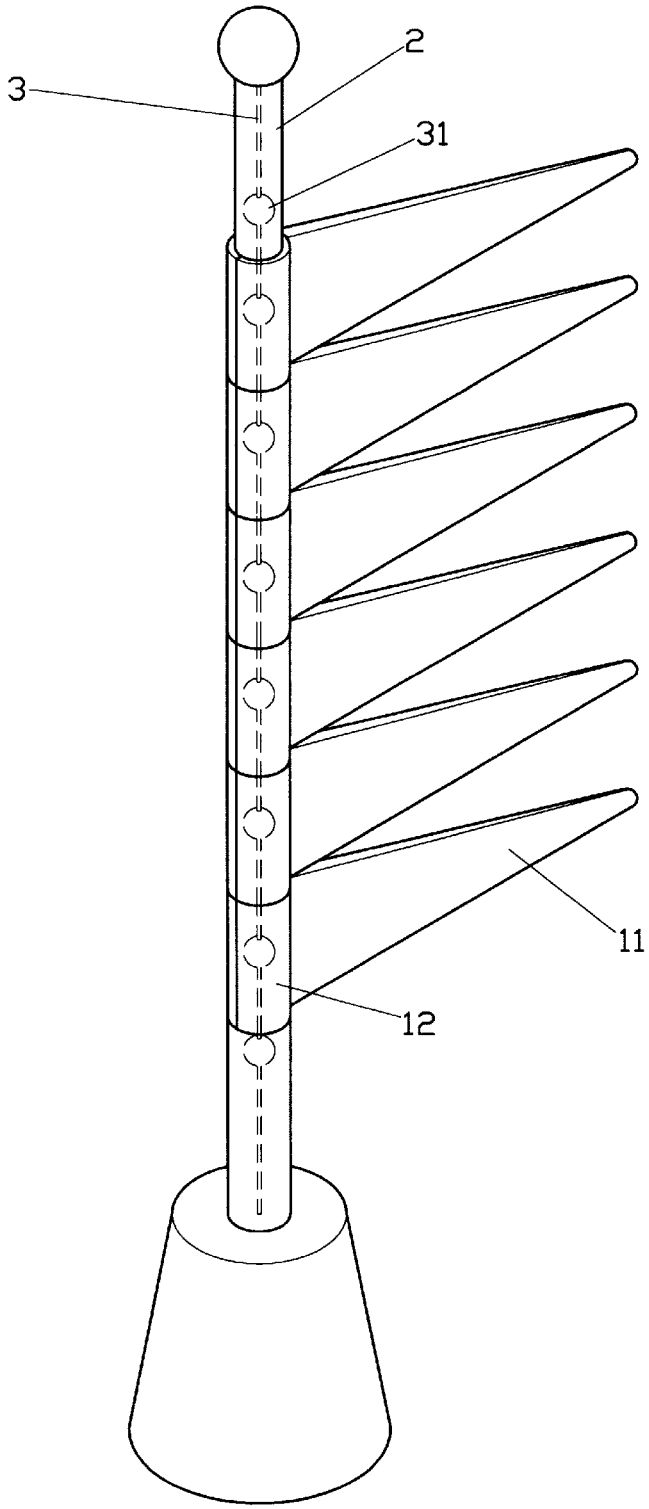

FIG. .2 is a solid view showing one unit of the flag of the present invention;

FIG. 3 is a solid view showing one unit of a second embodiment of the present invention;

FIG. 4 is a solid view showing one unit of a third embodiment of the present invention;

FIG. 5 is a solid view showing the second embodiment of the present invention; and FIG. 6 is a solid view showing the use of the flag-rod in the operation of the present invention.

DETAILED DESCRIPTION OF PREFERRED EMBODIMENTS

Figure 1:
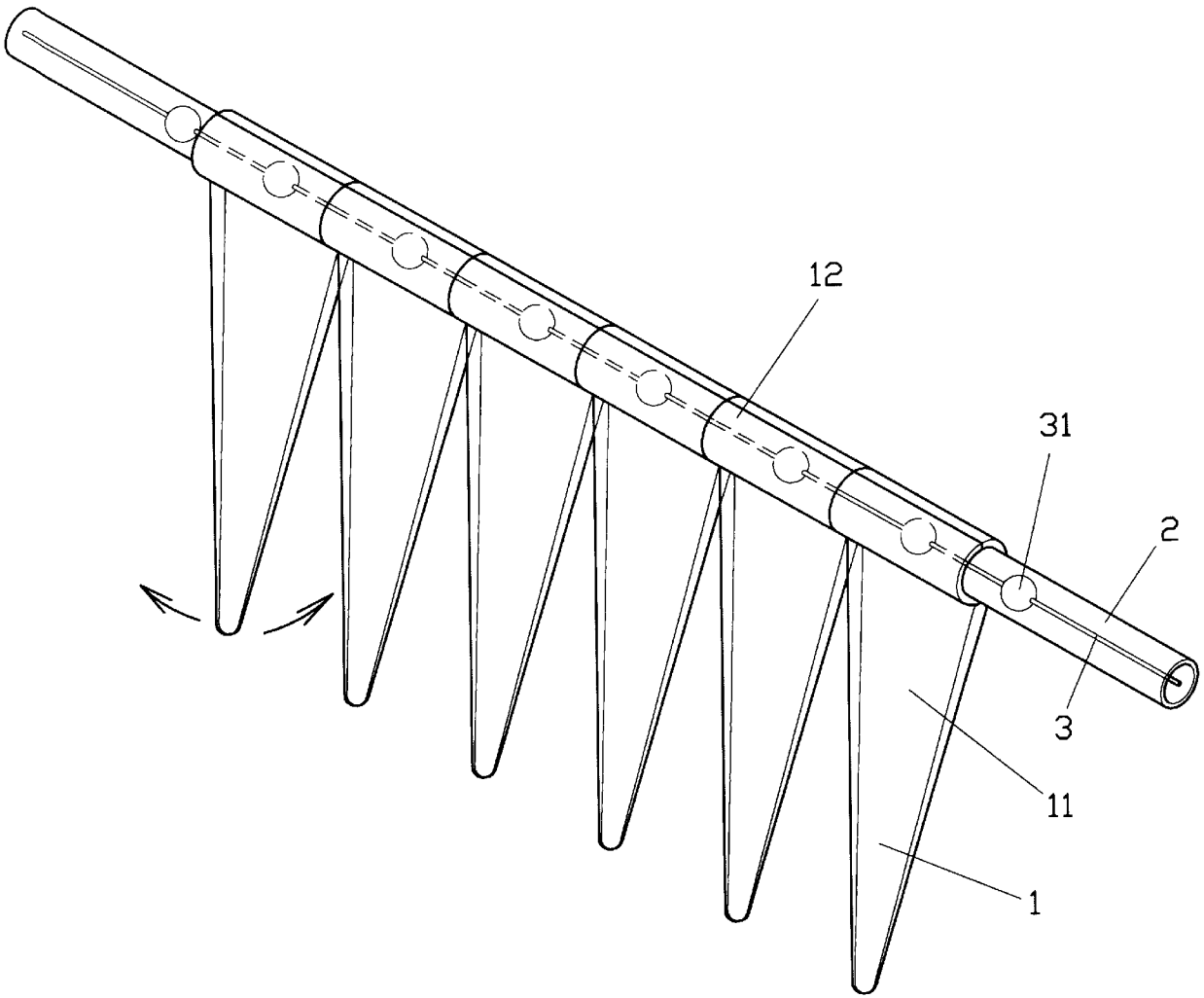
FIG. 1 is a solid view showing the first embodiment of the present invention.

Referring to FIG. 1, the present invention comprises a flag 1 pivotally attached on a transparent hollow tube 2, and several lamps 31 connected in series with a cable 3 located within the interior space of the tube 2, so that the light emitted by the bulbs 31 can be conducted into the banner to illuminate it.

Figure 2:
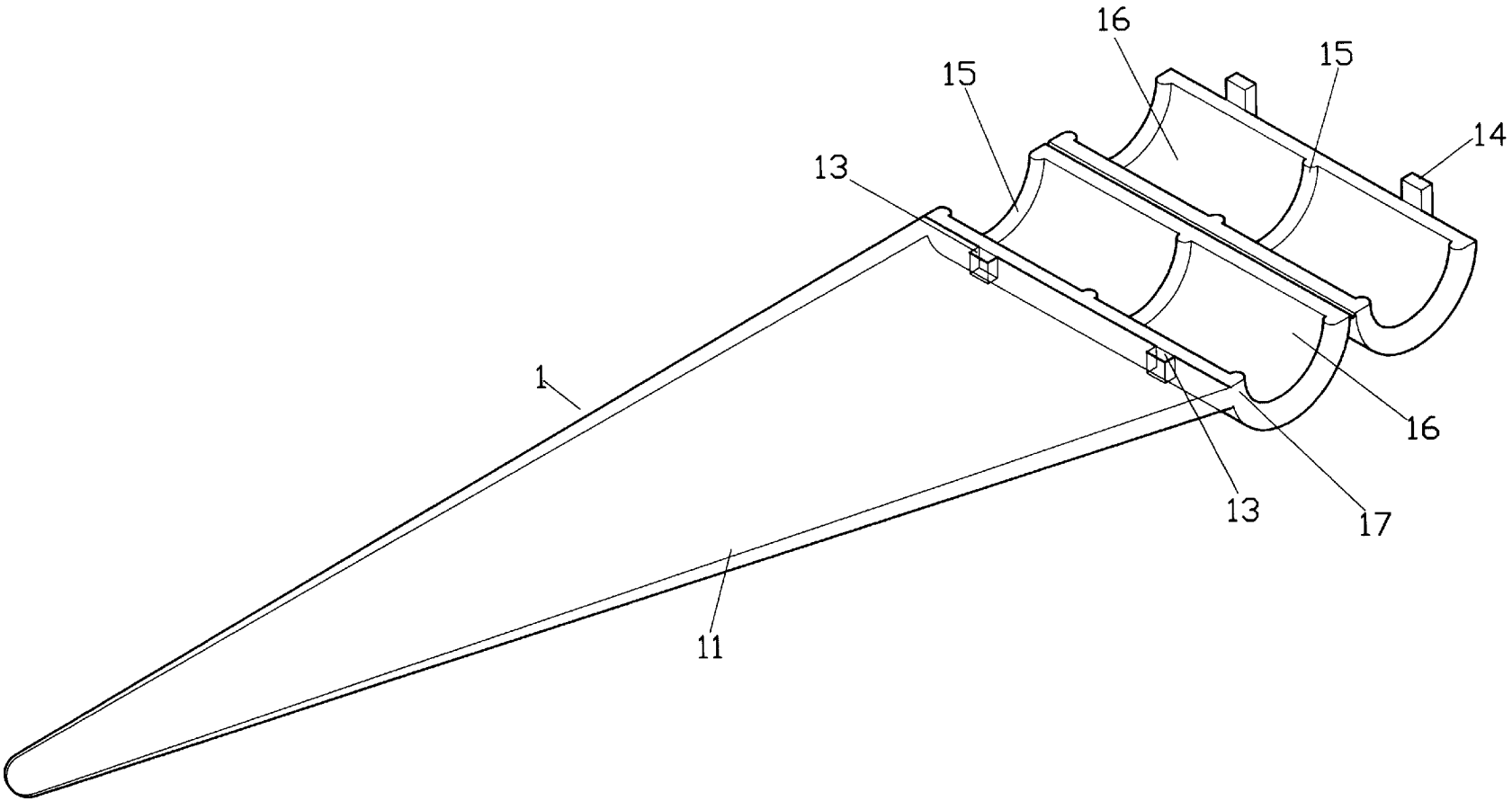

Referring to FIG. 2 said flag 1 includes the banner portion 11 and the lamp reflector portion 12. The lamp reflector 12 is made from transparent material and provided with two corresponding or complementary tube halves that connect together and a banner 11 extending at one open side. More than one socket 13 is formed in the connection area between the banner 11 and the lamp reflector 12. Corresponding to each socket 13 is a plug 14 formed on the opposite edge of the lamp reflector 12, so that they can be locked together as the lamp reflector 12 is attached to the tube 2. The inside of the lamp reflector 12 is provided with a proper number of ring-shaped fine 15 at both ends and a middle axial position for reducing the contact area and frictional force between the lamp reflector 12 and the tube 2 and preventing the surface of the outside wall of the tube 2 from being scratched and thereby affecting the light conductivity of the tube wall. Additionally, for increasing the reflecting efficiency of the lamp reflector 12, the inside of the lamp reflector 12 is coated by an electroplated layer 16, except the area of the connecting area 17 between the banner 11 and the lamp reflector 12 in order to direct light rays to the banner 11.

Referring to FIG. 3, a second embodiment of the present invention has two corresponding banners 11 respectively extending out from both open edges of the lamp reflector 12. The connecting areas between the banners 11 and the lamp reflector 12 are provided as photic zones 17. On the interface surfaces of the banners 11 there is provided cooperating plugs 14 and sockets 13.

Referring to FIG. 4, a third embodiment of the present invention has an engaging plate 18 smaller than the common banner 11. One edge of the free end of the engaging plate 18 has an opening for engaging a soft banner 11 with a glue connection or using ultrasonic welding. The other elements are the same an described in the first embodiment.

Referring to FIG. 1, the flags 1 can be pivotally attached on the tube 2, sequentially in series. or, as shown in FIG. 5, a transparent, spacing collar 4 is inserted between two adjacent flags 1 to maintain a space between the adjacent flags 1. The tube 2 is made from a soft material so that it can he bent in a desired shape to conform to a change in the environment. Referring to FIG. 6, the tube 2 in the present invention is made from a hard transparent material so it can be used as a standing flag-rod.

With respect to the lighting effect and referring to FIG. 1, FIG. 5 and FIG. 6, the light rays emitted from the bulbs 31 pass into the lamp reflector 12 via the tube 2. Referring to FIG. 2, FIG. 3 and FIG. 4, by means of the reflecting galvanized coating 16 at the inside of the lamp reflector 12, the light emitted from the bulbs 31 is condensed into the lamp reflector 12, and conducted into the transparent banner 11 via the photic zones 17 (and the banner engaging plate 18) to illuminate the banner 11. With respect to the revolving motion, the flag 1 with the lamp reflector 12 is mounted on the tube 2 by a pivotal connection, so that the flag 1 can be swiveled by the wind, and in cooperation with the light, it will appear at night to have a beautiful appearance. The ring fins 15 of the lamp reflector 12 not only reduce the friction area, the scratching area and frictional heat, but also fluently maintain the revolving motion of the flag 1.

I claim:

1. An electrolier flag comprising:

a longitudinally extended transparent tube;

a string of longitudinally spaced lamps disposed within said transparent tube; and, a plurality of flags pivotally connected to said transparent tube, each of said flags including a lamp reflector portion and a banner portion, said lamp reflector portion being formed by a pair of complementary semi-cylindrical members engaged one to the other around a portion of said transparent tube and forming a pivotal connection therewith, said banner portion including at least one banner member extending from at least one edge of at least one of said semi-cylindrical members, wherein light emissions from said lamps are conducted by said lamp reflector portion into said banner portion to illuminate said at least one banner member.

2. The electrolier flag as recited in claim 1, wherein said lamp reflector portion includes a plurality of ring shaped fins extending from an internal surface thereof for contacting an external surface of said transparent tube.

3. The electrolier flag as recited in claim 1, wherein said lamp reflector portion includes a reflective coating on an internal surface thereof, said lamp reflector portion having a photic zone formed by an internal surface area devoid of said reflective coating, said photic zone being in aligned relation with said at least one banner member.

4. The electrolier flag as recited in claim 1, wherein said banner portion includes a pair of banner members, each of said banner members being coupled to a respective one of said semi-cylindrical members.

5. The electrolier flag as recited in claim 1, wherein said banner portion further includes a banner engaging plate having a first end coupled to said at least one edge of said at least one of said semi-cylindrical members and an opposing second end engaging said at least one banner member, said second end of said banner engaging plate having an opening formed therein for securing said at least one banner member thereto.

* * * * *